US006273384B1

(12) United States Patent
Hallmark et al.

(10) Patent No.: US 6,273,384 B1
(45) Date of Patent: Aug. 14, 2001

(54) CHAIR BACK ADJUSTMENT MECHANISM

(75) Inventors: Michael C. Hallmark, Lancashire; Roger Davies, Stockton, both of (GB)

(73) Assignee: Unit Press Limited, Preston (GB)

( * ) Notice: Subject to any disclaimer, the term of this patent is extended or adjusted under 35 U.S.C. 154(b) by 0 days.

(21) Appl. No.: 09/316,204

(22) Filed: May 21, 1999

(30) Foreign Application Priority Data

May 22, 1998 (GB) ..... 9811209

(51) Int. Cl.[7] ..... B60N 2/02
(52) U.S. Cl. ..... 248/297.31; 297/353; 297/411.36
(58) Field of Search ..... 248/297.31, 244, 248/248, 407; 297/353, 356, 411.36; 403/105

(56) References Cited

U.S. PATENT DOCUMENTS

| | | | | |
|---|---|---|---|---|
| 4,012,158 | * | 3/1977 | Harper | 403/107 |
| 4,451,084 | * | 5/1984 | Seeley | 297/353 |
| 4,639,039 | * | 1/1987 | Donovan | 297/353 |
| 4,660,885 | * | 4/1987 | Suhr et al. | 297/353 |
| 4,749,230 | | 6/1988 | Tornero . | |
| 4,930,840 | * | 6/1990 | Tornero | 297/353 |
| 5,026,117 | | 6/1991 | Faiks et al. . | |
| 5,037,158 | * | 8/1991 | Crawford | 297/353 |
| 5,348,372 | | 9/1994 | Takamatsu et al. . | |
| 5,375,912 | | 12/1994 | Stulik et al. . | |
| 5,547,253 | | 8/1996 | Schwartz et al. . | |
| 5,582,460 | * | 12/1996 | Schultz | 297/353 |
| 5,584,533 | | 12/1996 | Schrewe . | |
| 5,586,809 | * | 12/1996 | Szmadzinski | 297/353 |
| 5,597,204 | * | 1/1997 | Karaus, Jr. | 297/353 |
| 5,649,741 | | 7/1997 | Beggs . | |
| 5,678,893 | | 10/1997 | Bock . | |
| 5,685,609 | * | 11/1997 | Miotto | 297/353 |
| 5,695,249 | * | 12/1997 | Lotfi | 297/353 |
| 5,853,222 | * | 12/1998 | Roslund, Jr. et al. | 297/353 |
| 5,918,935 | | 7/1999 | Stulik et al. . | |
| 5,951,107 | * | 9/1999 | Tornero | 297/353 |

FOREIGN PATENT DOCUMENTS

| | | |
|---|---|---|
| 0 587 536 | 3/1994 | (EP) . |
| 2 732 870 | 10/1996 | (FR) . |
| 1 371 641 | 10/1974 | (GB) . |
| 2 180 147 | 3/1987 | (GB) . |

* cited by examiner

*Primary Examiner*—Anita M. King
(74) *Attorney, Agent, or Firm*—Hollander Law Firm, P.L.C.

(57) ABSTRACT

A mechanism for adjusting the height of a back part (3) of a typist's chair uses a sleeve-shaped slider (13) on the back part which slides along a rigid bar (8), and an interengageable pawl (37) and rack (22 or 23) are used to retain the back part (3) in an adjusted position. The sleeve (13) is accurately guided on the bar by engagement of projections (42, 43) such as lengths of cord, with grooves (40, 41). This guide arrangement can also be used for guiding movement of separate parts on furniture or in other applications.

20 Claims, 4 Drawing Sheets

CHAIR BACK ADJUSTMENT MECHANISM

This invention relates to a slider mechanism particularly although not exclusively for adjusting the height of the back part of a chair, especially an office chair, or typist's chair, of the kind which is used for working at a desk in front of word processing or computer equipment.

A conventional office or typist's chair has a wheeled base which supports a seat part and an upstanding rigid flat bar or elongate plate on which a back part is mounted. Typically the back part is movable longitudinally of the bar or plate for height adjustment purposes.

The back part may be movably mounted via a slider in the form of a sleeve which wraps around edges of the bar or plate, a mechanism of the nature of a ratchet having a pawl engageable with a toothed rack being provided to hold the sleeve relative to the bar or plate at a selected position along its length.

With this known arrangement the requirement is that the slider should move easily along the bar or plate but without undue transverse movement or play. This can be achieved by use of precision engineering to produce a slider having dimensions, particularly the separation between face parts, and between edge parts of the slider, which have close predetermined tolerances in relation to the corresponding dimensions of the bar or plate.

However, this is an expensive solution from the manufacturing point of view.

One object of the present invention is to attain the requirements for easy sliding and minimal play with a construction which can be manufactured relatively easily and inexpensively.

According to one aspect of the invention therefore there is provided an adjustment mechanism for adjusting the height of a back part of a chair comprising an elongate rigid support member having a longitudinally extending guide face bounded by edges, a slider for attachment to the back part mounted on the member so as to be slidable longitudinally thereof, said slider having a face part overlying the guide face and edge parts which locate around said edges of the member, and selectively interengageable parts on the slider and the member to releasably retain the slider and member in a selected position longitudinally of the member, characterised by the provision of a guide arrangement comprising at least one groove provided on one of the member and the slider and extending longitudinally of the member, and at least one projection slidably engageable with the groove and provided on the other of the member and the slider.

With this arrangement it is possible to attain precise guiding with a construction which can be easily and inexpensively manufactured in so far as precision formation of the (or each) groove can be more readily achieved than precision control of lateral dimensions of the slider.

Most preferably the (or each) groove is provided in the elongate member. Any suitable manufacturing process may be used although stamping or pressing is preferred since this is a convenient means of ensuring precise location and dimensions. The or each groove may be of V-shaped formation.

In practice, the transverse position and dimensions of the (or each) groove are selected, in relation to the (or each) projection, to maintain a desired positioning of the slider transversely (i.e. between the said edges) on the elongate member.

Also, the depth of the (or each) groove may be selected with precision, in relation to the (or each) projection, to maintain a desired positioning of the slider laterally (i.e. perpendicularly to the said guide face). In this case the slider and the elongate member will have confronting surfaces at an opposite side of the guide member to the guide face and the arrangement may be such that the (or each) groove and the (or each) projection are provided between the said guide face and face part, and a further guide arrangement is provided between the said confronting faces.

This further guide arrangement may be of like form to the first said guide arrangement i.e. comprising at least one further said groove interengageable with at least one further said projection. Most preferably the grooves of both guide arrangements are provided in the elongate member and the (or each) groove of the first said guide arrangement is superimposed with the (or a respective) groove of the further guide arrangement. With this latter construction, particularly using a stamping or pressing technique, it can be ensured that the bottoms of opposed superimposed grooves have an accurately predetermined separation which helps maintain location of the slider perpendicularly to the guide face.

There may be any number of grooves, preferably two or more at spaced apart positions for the (or each) said guide arrangement. In a particularly preferred embodiment there are two parallel straight grooves for the (or each) said guide arrangement.

Most preferably the member is a flat bar or elongate plate and has a further face opposite to the said guide face also bounded by the said edges. This further face and the guide face may be flat and parallel to each other. The edges of the elongate member may be straight and parallel to each other.

The slider may be in the form of a sleeve having a further part linking the said edge part and overlying the further face of the elongate member. Alternatively, the slider may be C-shaped having edge parts which are inturned over the further face of the elongate member but are not linked.

With regard to the (or each) projection this may take any suitable form capable of ensuring good sliding location in the respective groove. Preferably the (or each) projection is of elongate form.

In accordance with one embodiment the (or each) projection may be formed by a projecting length of strong cord or filamentary material, such as high strength, low-extension nylon filament, such material being fixed in position at its ends so that the body of the material extends into and runs along the respective groove.

Alternatively the (or each) projection may comprise a suitably shaped elongate body formed from plastics or any other suitable material.

With regard to the said selectively interengageable parts between the slider and the elongate member, these may take any suitable form.

In one preferred embodiment, these parts comprise respectively a longitudinally extending rack of teeth and a pawl member, the pawl member being slidably located within an inclined guide slot so that it is movable between the retracted position at which the rack is free to move relative to the pawl member, and an engaged position at which the pawl member engages the rack, at a selected position between adjacent teeth thereof, to hold the slider relative to the elongate member.

The arrangement may be such that the interengagement of the pawl member with the rack prevents downward movement of the rack but permits upward movement whereby when the pawl member is engaged with the uppermost end of the rack it is possible to move the rack upwardly relative to the pawl member to select a lower position on the rack for engagement with the pawl member. A deflecting structure may be provided at the bottom of the rack so that on reaching the lowermost position the pawl member is deflected out of engagement with the rack whereby the rack can be moved fully downwardly relative to the pawl member to return the pawl member to the uppermost position on the rack.

This arrangement is described in U.S. Pat. No. 4,749,230.

As an alternative to this arrangement, and to avoid the need to move the rack fully upwardly relative to the pawl member before the full range of height adjustment is available, the interengageable parts may comprise a longitudinally extending rack of teeth and a pawl member with a manual operating device, such as a lever for moving the pawl member along a guide slot out of engagement with the rack when adjustment is required, the pawl member being movable back into engagement with the rack by gravity or a spring or otherwise as desired.

The above two mentioned rack and pawl-member arrangements may be provided together so that the mechanism may be set up for use with either arrangement as desired. Thus there may be two racks and two guide slots and a single pawl member transferable between the slots. Other arrangements and means of transfer are also possible and thus for example the same rack may be used for both arrangements.

Thus and in accordance with a second aspect of the present invention there is provided an adjustment mechanism for adjusting the height of a back part of a chair comprising an elongate rigid support member having a longitudinally extending guide face bounded by edges, a slider for attachment to the back part mounted on the member so as to be slidable longitudinally thereof, said slider having a face part overlying the guide face and edge parts which locate around said edges of the member, and selectively interengageable parts on the slider and the member to releasably retain the slider and member in a selected position longitudinally of the member characterised in that the said interengageable parts comprise first and second arrangements each comprising a longitudinally extending rack of teeth as one said part and a pawl member as another said part, said arrangements being individually selectable whereby either one is operational whilst the other is disabled, the first said arrangement being arranged such that upward movement of the rack relative to the pawl member is required to disengage the pawl member from the rack whereas the second said arrangement incorporates a manual control to effect disengagement of the pawl member from the rack.

The arrangements may have respective said racks and a common said pawl member transferable between the racks to effect said selection of the operational arrangement.

The arrangements may be as described above in connection with the first aspect of the invention.

With the arrangements of both the first and second aspects of the invention preferably the (or each) pawl member is mounted on the elongate member and the (or each) rack is provided on the slider.

Whilst the invention is particularly concerned with the provision of height adjustment for chair backs, it is to be understood that the invention is not exclusively confined to this application. The above described improved guide arrangement may be used for guiding sliding movement in other fields of application, for example sliding desk tops, drawer slides, cable management or any other application where controlled sliding of separate components is required particularly although not exclusively in relation to furniture or office equipment or the like.

Thus, and in accordance with a further aspect of the invention there is provided a slider mechanism comprising first and second elongate members, retaining means for retaining the members relative to each other whilst permitting longitudinal sliding movement of one of the members relative to the other of the members, characterised by the provision of a guide arrangement comprising at least one groove provided on one of the members extending longitudinally thereof and at least one projection slidably engageable with the groove and provided on the other of the said members.

The members may comprise respectively a support member having a longitudinally extending guide face bounded by edges, and a slider mounted on the support member so as to be slidable longitudinally thereof, said slider having a face part overlying the guide face and edge parts which locate around said edges of the member, as described in accordance with the first aspect of the invention.

The features of the support member, the slider, as also the groove and the projection may be respectively as described above in connection with the first aspect of the invention.

There may be selectively interengageable parts on the first and second members, as described in accordance with the first aspect of the invention.

The invention will now be described further by way of example only and with reference to the accompanying drawings in which.

Figure 1:
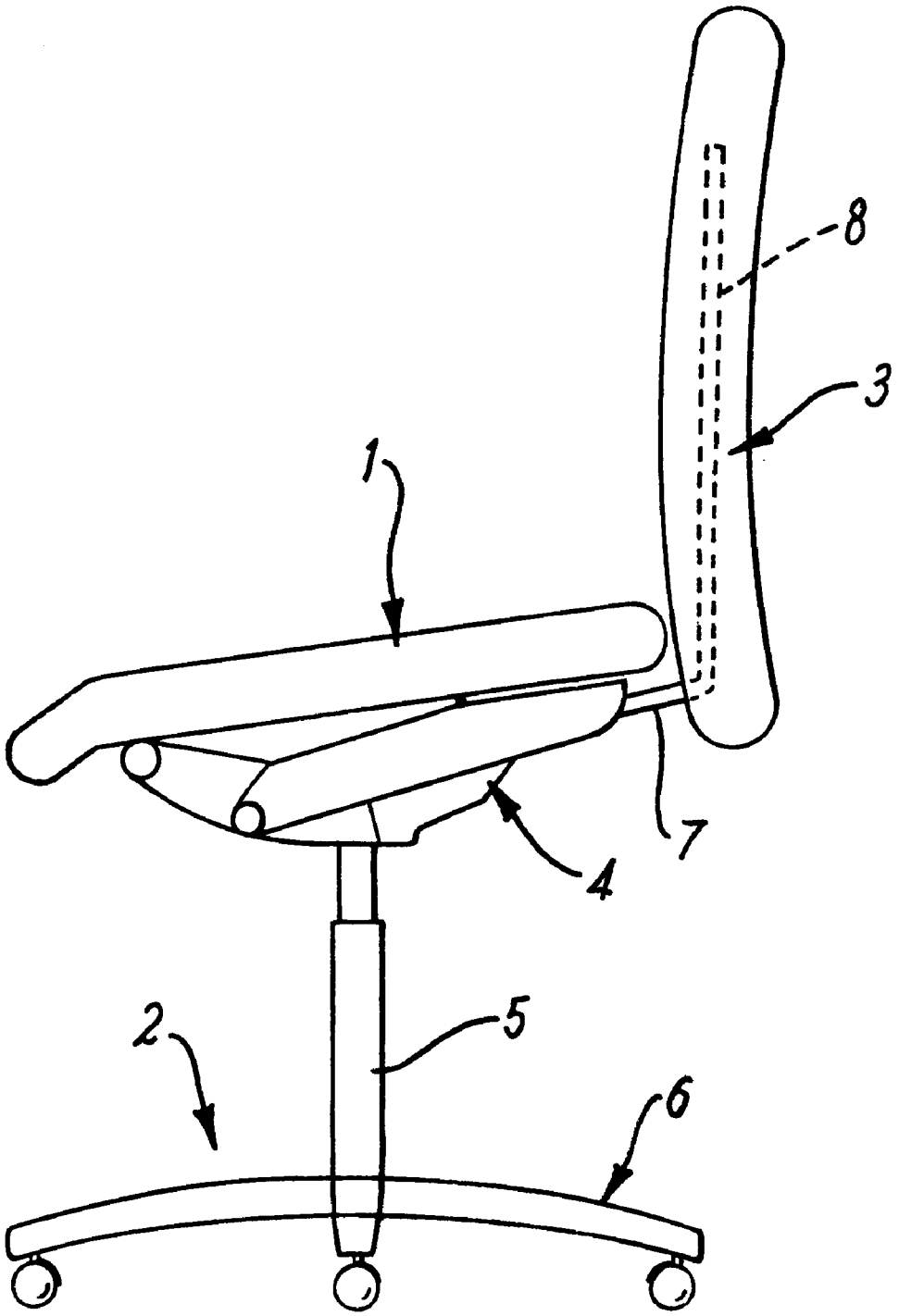
FIG. 1 is a diagrammatic representation of a chair incorporating one form of an adjustment mechanism according to the invention.
Figure 2:
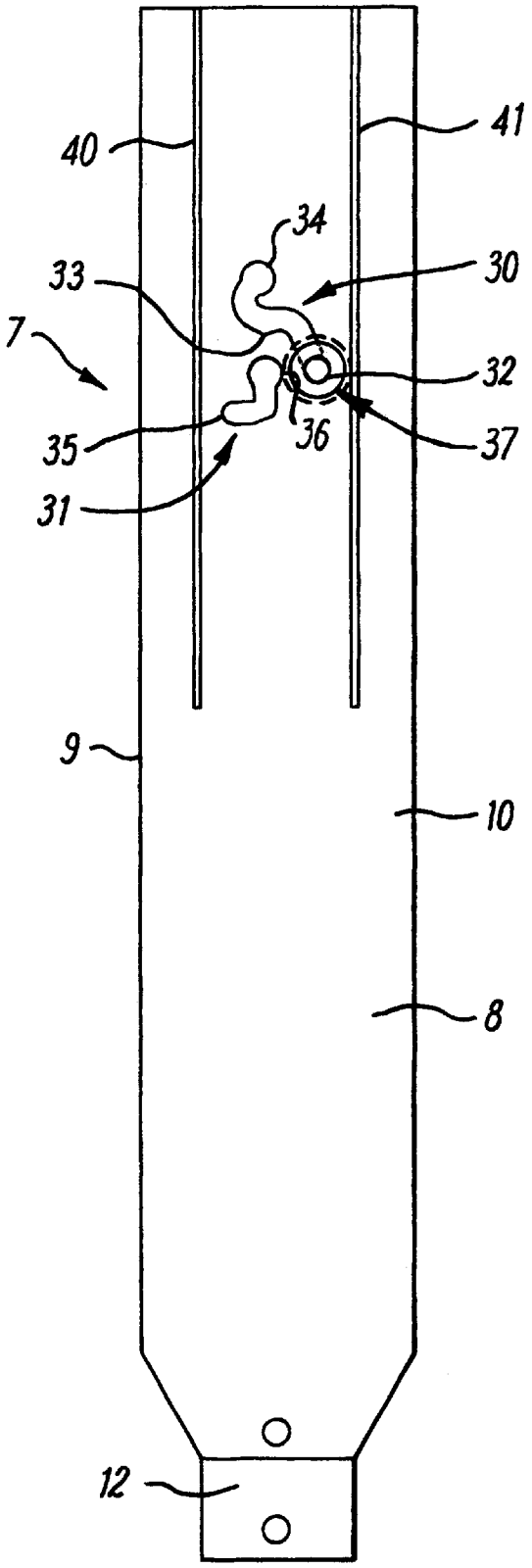
FIG. 2 is a front view of an elongate member of the adjustment mechanism shown opened out.
Figure 3:
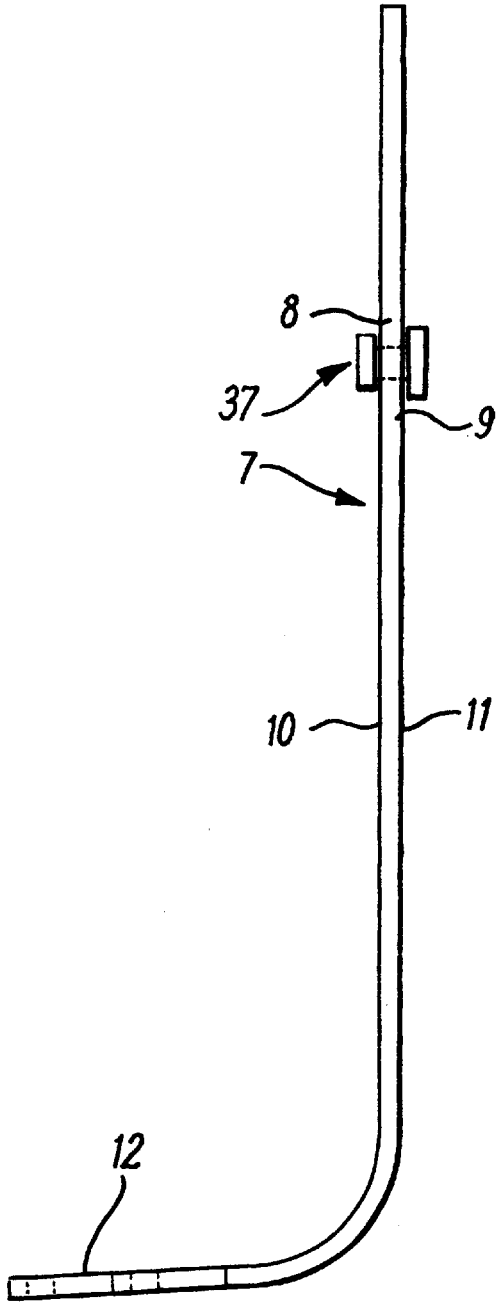
FIG. 3 is a side view of the elongate member.

Referring to the drawings, FIG. 1 shows an office chair having a seat part 1, a base part 2, and a back part 3, all interconnected via a tilt mechanism 4.

The base part comprises a vertical central support pillar 5 attached at its lower end to a five-arm wheeled floor-engaging structure 6. At its upper end the pillar 5 is attached to the tilt mechanism 4 beneath the seat part 1. In conventional manner the pillar 5 contains a gas cylinder height adjusting mechanism which is operated by a manual control (not shown) comprising a cam and a shaft which engages with a valve at the end of the gas cylinder on operation of the shaft by means of a control knob or lever.

The seat part 1 comprises a padded seat structure on a frame which is attached to the tilt mechanism 4.

The back part 3 comprises a padded back structure which is adjustably attached to an upstanding arm of a rigid L-shaped plate member 7 which is attached to the tilt mechanism 4.

The mechanism 4 permits adjustment of inclination of the seat part 1. A suitable mechanism is disclosed in our copending application 9802447.4.

The L-shaped plate member 7 is a rigid metal member which has a main upstanding limb 8 having straight, mutually parallel edges 9 and flat front and back mutually parallel faces 10, 11. The member 7 also has a shorter, forwardly directed lower limb 12 which has edges and opposite faces coextensive with the edges 9 and faces 10, 11 of the main limb 8, although the free end of this limb 12 is tapered to define a narrower flange with fixing holes.

A slider 13 fits around the main limb 8 so as to be movable longitudinally of this. The slider 13 is in the form of a sleeve defined by two metal plates 14, 15 having flat main regions 16, 17 slightly wider than the main limb 8, and outwardly projecting edge regions 18, 19 stepped inwardly through a distance slightly greater than half the thickness of the limb 8.

The two edge regions 18, 19 of the two plates are fixed together in face to fact contact whereby the main regions 16, 17 are spaced apart by slightly more than the thickness of the limb 8.

The main region 16 of the front plate 14 has a longitudinally extending central part which is stepped outwardly to define a central channel 20.

The main region 17 of the back plate 15 has a central longitudinally extending shaped cut-out 21 which defines first and second toothed racks 22, 23 with arcuate spaces 24, 25 between pointed teeth 26, 27. The racks 22, 23 are straight and extend, in mutually spaced apart disposition longitudinally of the main limb 8.

At the lower extremity of the first rack 22 the cut out 21 has an inclined shoulder 28 extending downwardly and forwardly away from the rack 22, leading from the lowermost rack space 24. At the upper extremity of this rack 22 there is a further inclined shoulder 29 which extends downwardly and forwardly away from the rack 22 leading from the uppermost rack space 24.

In the central region of the main limb 8 there are two shaped slots 30, 31. The slider 13 can be positioned on the main limb 8 such that these slots 30, 31 are located within the cut out 21 of the back plate 15 and within the channel 20 of the front plate 14.

A first one of the slots 30 is configured for use with the first rack 22. This slot 30 has one end 32 within the region of the bottoms of the curved rack spaces 24, and the slot 30 extends upwardly from this end away from the rack to a slightly downwardly extending intermediate resting position 33 and from there to an upwardly extending part terminating in an enlarged top end 34.

A second one of the slots 31 is configured for use with the second rack 23. This slot 31 has one end 35 level within the region of the bottoms of the curved rack spaces 25, and the slot 31 extends from there inwardly away from the rack and then upwardly terminating in an enlarged end portion 36.

Within a selected one of the slots 30, 31 (for use in a manner yet to be described) there is located a pawl member 37 engageable between the teeth 26, 27 of the respective rack 22, 23. The pawl member 37 is in the form of a stud having a central cylindrical body part 38 which slides easily along the slot, and respective enlarged cylindrical heads 39 (of different diameters) on opposite ends which fit on opposite sides of the main limb 8 and retain the stud 37 in the slot 30, 31. The channel 20 of the front plate 14 of the slider 13 provides space for the adjacent (smaller diameter) head 39 of the pawl member 37.

The slider 13 is fixed to the chair back part 3 by fixing studs or bolts engaging holes in the end regions 18, 19 and also holes in a mounting plate (not shown) within the back part 3.

The slider 13 can slide up and down on the main limb 8 to enable the height of the back part 3 to be adjusted. The back part 3 can be held securely in an adjusted position by engagement of the pawl member 37 with one of the racks 22, 23 in a manner yet to be described.

In order to achieve smooth sliding of the slider 13 along the main limb 8 without undue play either transversely across the limb 8 (i.e. in the direction between the edges 9) or from front to back, a guide arrangement is provided as follows:

The main limb 8 is provided with two spaced apart mutually parallel V-shaped grooves 40, 41 on each of its front and back faces 10, 11. The grooves 40, 41 run parallel to the edges 9 and the grooves 40, 41 on one side are in direct superimposed relationship with regard to the grooves 40, 41 on the other side of the limb 8. Moreover the grooves 40, 41, on one side are identical, with regard to length, width, depth and profile, with the grooves 40, 41 on the other side.

The grooves 40, 41 are formed by a stamping or pressing operation whereby the dimensions and particularly the depths of the grooves, and hence the separation of the bottom of superimposed grooves, can be precisely controlled.

The grooves 40, 41 are near to the edges 9 of the main limb 8, within the area of the parts of the main regions 16, 17 of the slider plates 14, 15, outside the central cut out 21 and outside the central channel 20. On the inner faces of these parts of the slider plates 14, 15 there are fixed longitudinally extending projections 42, 43 which slidably interengage with the grooves 40, 41.

Figure 9:
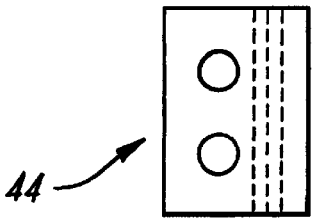
FIGS. 9 & 10 are top and side views of an alternative version of a guide projection of the mechanism.
Figure 10:
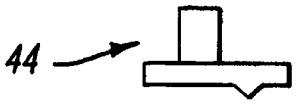
Figure 11:
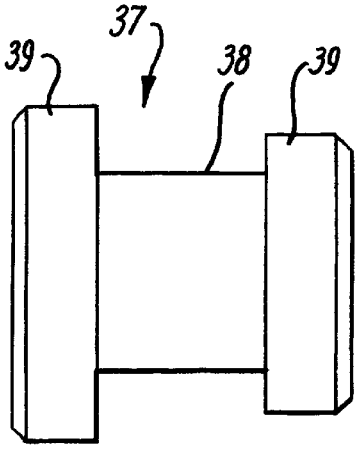
FIG. 11 is a side view of a pawl member of the mechanism.

These projections 42, 43 may comprise strong inextensible cords or filaments (e.g. nylon filaments) fixed at their ends (e.g. by knotting through holes in the plates), or as shown in FIGS. 9 and 10 they may comprise purpose made plastics extrusions 44 fixed to the plates 14, 15.

These projections 42, 43 or 44 fit within the grooves 40, 41 to permit easy longitudinal sliding whilst ensuring that there is minimal transverse or lateral play of the slider 13 on the main limb 8.

The height adjustment mechanism so far described can be set up to be of the conventional kind requiring an external manual release lever, or of the known kind requiring no external release lever.

In the latter case, the pawl member 37 is disposed within the slot 30 provided for use with the first rack 22. The pawl member 37 drops to the bottom end 32 of the slot 30 under the influence of gravity and engages one of the rack spaces 24. Any attempt at moving the back part 3 and the slider 13 downwardly jams the rack 22 against the pawl member 37 and securely resists this movement.

Height adjustment is effected by lifting the back part 3 so that the pawl member 37 is deflected up the slot 30 to the intermediate resting position 33 by the action of the teeth 26 and the shoulder 28. The back part 3 can then be pushed down until the pawl member 37 is deflected by the top shoulder 29 back to the bottom of the slot 30 to engage the uppermost rack space 24. The back part 3 can then be lifted to cause the pawl member 37 to engage lower rack spaces 24 one by one until the desired height is reached.

As an alternative the mechanism can be set up to use the second rack 23 by removing the pawl member 37 from the enlarged top end 34 of the slot 30, and inserting it into the other slot 31 through the enlarged top end 36 of this.

The pawl member 37 then engages the second rack 23 by gravity (or if desired by spring pressure) and, in conventional manner the height of the seat part is adjusted by moving the pawl member 37 out of engagement with the rack with a manual lever, the pawl member 37 being released to reengage the rack 23 when the desired height has been attained.

Figure 4:
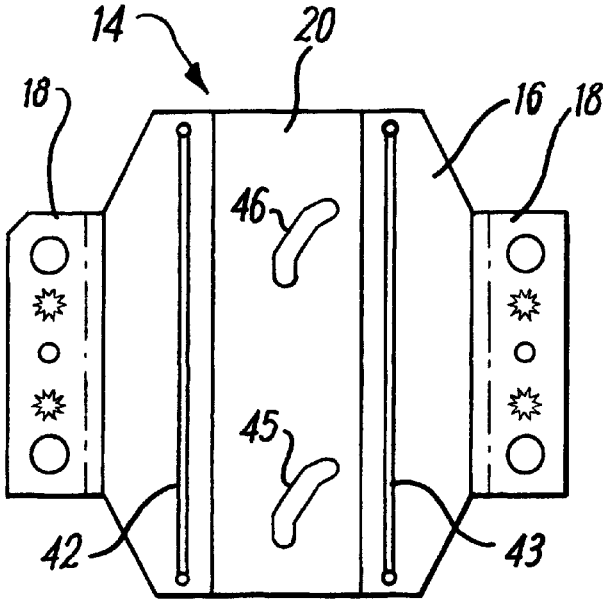
FIGS. 4 & 5 are views of front and back parts of a slider of the mechanism.
Figure 5:
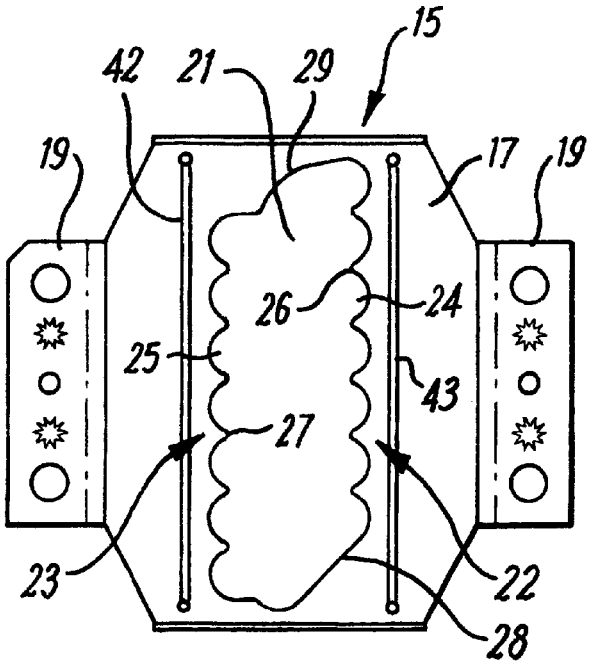
Figure 6:
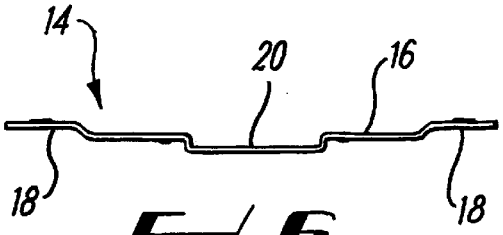
FIGS. 6 & 7 are cross-sectional views of the front and back parts of FIGS. 4 & 5
Figure 7:
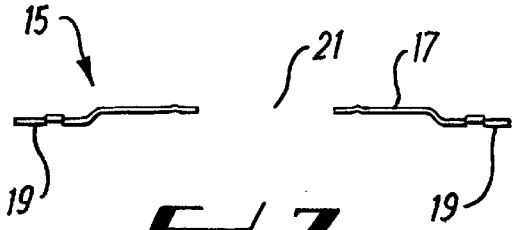
Figure 8:
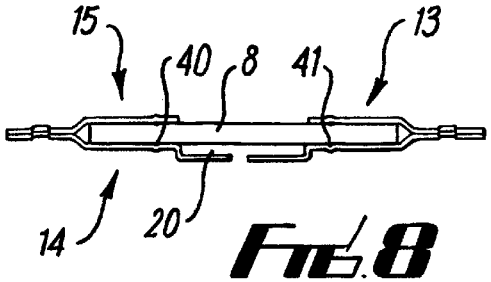
FIG. 8 is a sectional view of the slider in position on the elongate member.

The manual lever may cause a locking bar (not shown) to slide up and down engaging the end of the pawl member 37 through a shaped slot 45 in the front plate 1 as shown in FIG. 4, another slot 46 being provided for a guide link between the plate 14 and the locking bar.

With this arrangement, smooth, easy height adjustment can be achieved without undue play using a mechanism which can be constructed without requiring expensive precision engineering techniques.

It is of course to be understood that the invention is not intended to be restricted to the details of the above embodiment which are described by way of example only.

What is claimed is:

1. An adjustment mechanism for adjusting the height of a back part of a chair comprising an elongate rigid support member having a longitudinally extending guide face bounded by edges, a slider for attachment to the back part mounted on the member so as to be slidable longitudinally thereof, said slider having a face part confronting and overlying the guide face and edge parts which locate around said edges of the member, and selectively interengageable parts on the slider and the member to releasably retain the slider and member in a selected position longitudinally of the member, wherein a guide arrangement is provided comprising at least one groove in the guide face of the member or in said confronting face part and extending longitudinally of the member or face part, and at least one projection slidably engageable with the groove and provided on the other of the member and the slider between the said guide face and said confronting face part.

2. An adjustment mechanism according to claim 1 wherein said at least one groove is provided on said guide face, and said at least one projection slidably engageable with said at least one groove is provided on said confronting face part.

3. An adjustment mechanism for adjusting the height of a back part of a chair, comprising an elongate rigid support member having first and second longitudinally extending guide faces on opposite sides bounded by edges, a slider for attachment to the back part mounted on the member so as to be slidable longitudinally thereof, said slider having first and second face parts confronting and overlying respectively the first and second guide faces and edge parts which locate around said edges of the member, and selectively interengageable parts on the slider and the member to releasably retain the slider and member in a selected position longitudinally of the member, wherein a first guide arrangement is provided comprising at least one groove provided in the first guide face of the member and extending longitudinally of the member, and at least one projection slidably engageable with the groove and provided on the slider between the said first guide face and the confronting said first face part, and wherein a further guide arrangement is provided between the said second guide face and the second face part.

4. A mechanism according to claim 3 wherein the said groove is of V-shaped formation.

5. A mechanism according to claim 3 wherein the further guide arrangement comprises at least one further groove in the second guide face of the member interengageable with at least one further projection on the slider.

6. A mechanism according to claim 5 wherein the groove of the first said guide arrangement is superimposed with the groove of the further guide arrangement.

7. A mechanism according to claim 5 wherein there are two parallel straight grooves for said guide arrangement.

8. A mechanism according to claim 3 wherein the member is a flat bar or elongate plate.

9. A mechanism according to claim 8 wherein the slider is in the form of a sleeve.

10. A mechanism according to claim 8 wherein the slider is C-shaped.

11. A mechanism according to claim 3 wherein the projection is formed by a projecting length of cord or filamentary material.

12. A mechanism according to claim 3 wherein the projection comprises a solid elongate body.

13. A mechanism according to claim 3 wherein the interengageable parts comprise respectively a longitudinally extending rack of teeth and a pawl member, the pawl member being slidably located within an inclined guide slot so that the pawl member is movable between a retracted position at which the rack is free to move relative to the pawl member, and an engaged position at which the pawl member engages the rack, at a selected position between adjacent teeth thereof, to hold the slider relative to the elongate member.

14. A mechanism according to claim 13 wherein the interengagement of the pawl member with the rack prevents downward movement of the rack but permits upward movement.

15. A mechanism according to claim 14 wherein a deflecting structure is provided at the bottom of the rack so that on reaching the lowermost position the pawl member is deflected out of engagement with the rack.

16. A mechanism according to claim 3 wherein the interengageable parts comprise a longitudinally extending rack of teeth and a pawl member with a manual operating device, for moving the pawl member along a guide slot out of engagement with the rack.

17. A mechanism according to claim 3 wherein the said interengageable parts comprise first and second arrangements each comprising a longitudinally extending rack of teeth as one said interengageable part and a pawl member as another said interengageable part, said arrangements being individually selectable whereby either one is operational whilst the other is disabled, the first said arrangement being arranged such that upward movement of the rack relative to the pawl member is required to disengage the pawl member from the rack whereas the second said arrangement incorporates a manual control to effect disengagement of the pawl member from the rack.

18. A mechanism according to claim 17 wherein the first and second arrangements have respective said racks and a common said pawl member transferable between the racks to effect the said selection of the operational arrangement.

19. A mechanism according to claim 17 wherein the pawl member is mounted on the elongate member and the rack is provided on the slider.

20. An adjustment mechanism for adjusting the height of a back part of a chair comprising an elongate rigid support member having a longitudinally extending guide face bounded by edges, a slider for attachment to the back part mounted on the member so as to be slidable longitudinally thereof, said slider having a face part confronting and overlying the guide face and edge parts which locate around said edges of the member, and selectively interengageable parts on the slider and the member to releasably retain the slider and member in a selected position longitudinally of the member, wherein said elongate member has a further face opposite to said guide face and said slider is in the form of a sleeve having a further part linking said edge of said elongate member and overlying said further face.

* * * * *